United States Patent [19]

Mihara

[11] Patent Number: 4,543,902

[45] Date of Patent: Oct. 1, 1985

[54] CONSTRUCTION OF HULL OF VESSEL SUCH AS TANKER

[76] Inventor: Osamu Mihara, 7-15, Kugenuma-Kaigan 3-chome, Fujisawa-shi, Kanagawa-ken, Japan

[21] Appl. No.: 501,936

[22] Filed: Jun. 7, 1983

[30] Foreign Application Priority Data

Jun. 15, 1982 [JP] Japan ..... 57-101293

[51] Int. Cl.[4] ..... B63B 25/12

[52] U.S. Cl. ..... 114/74 R; 114/56; 114/346

[58] Field of Search ..... 114/74 R, 74 A, 74 T, 114/256, 346, 355, 253, 56, 257, 267

[56] References Cited

U.S. PATENT DOCUMENTS

| | | | |
|---|---|---|---|
| 2,720,181 | 10/1955 | Brandon | 114/74 R |
| 2,995,104 | 8/1961 | Mills | 114/355 |
| 2,998,792 | 9/1961 | Hasler | 114/74 T |
| 4,023,514 | 5/1977 | Finsterwalder et al. | 114/256 |
| 4,170,954 | 10/1979 | Rinaldi | 114/256 |
| 4,195,951 | 4/1980 | Finsterwalder | 114/256 |
| 4,224,891 | 9/1980 | Rinaldi | 114/256 |
| 4,377,982 | 3/1983 | Gongwer | 114/56 |
| 4,438,719 | 3/1984 | Finsterwalder | 114/253 |

FOREIGN PATENT DOCUMENTS

| | | | |
|---|---|---|---|
| 622993 | 1/1963 | Belgium | 114/74 R |
| 816063 | 10/1951 | Fed. Rep. of Germany | 114/256 |
| 2733240 | 2/1979 | Fed. Rep. of Germany | 114/256 |

*Primary Examiner*—Trygve M. Blix
*Assistant Examiner*—Thomas J. Brahan
*Attorney, Agent, or Firm*—Roy F. Hollander

[57] ABSTRACT

Disclosed is a hull of a vessel such as a tanker. The hull is basically composed of three hemispheres, at least of two of the hemispheres having an equal diameter, the three hemispheres being connected to one another such that the lines connecting the center of the hemisphere located at the bow side to the centers of the two hemispheres of the equal diameter constitute two sides of an equilateral triangle. With this hull construction, it is possible to obtain the maximum internal volume with minimized outer surface area, while attaining a superior steering and running performance.

4 Claims, 4 Drawing Figures

CONSTRUCTION OF HULL OF VESSEL SUCH AS TANKER

BACKGROUND OF THE INVENTION

1. Field of the Invention

The present invention relates to a construction of hull of a vessel such as a tanker. More particularly, the invention is concerned with a hull having a construction composed of three hemispheres to attain the maximum internal volume with the minimum outer surface area, while attaining a good stability of the vessel.

2. Description of the Prior Art

Nowadays, the size of hulls of vessels such as tankers is becoming large, and various proposals and attempts are made to maximize the transportation of crude oil or liquefied natural gas per voyage. However, it is considered that there is a practical limit of 500,000 tons in the hull size, as far as the conventional hull construction having substantially rectangular cross-section is concerned, for the following reasons.

Namely, the effect or advantage brought about by the increase of the hull size is not so remarkable, considering the increase of the amount of steel material to be used, when the hull size is increased beyond the above-mentioned practical limit. In addition, the increased hull size imposes a problem concerning the mechanical strength of the hull. Furthermore, the increased hull size correspondingly decreases the speed of the vessel. Much more fuel will be consumed for maintaining the desired speed with the increased hull size. Furthermore, as the hull size such as overall length is increased, the levels of stresses caused by various resistance forces such as wave making resistance to impractically increase the deflection of the hull.

From a mathematical point of view, it is clear that a spherical hull shape (hemispherical shape in actual application) offers the maximum internal volume for a given surface area, i.e. for a given consumption of the steel. From this standpoint, the present inventor has worked out a hemispherical hull and conducted a performance test with this hull. As a result, the inventor has found out that a mere hemispherical hull afloat on the water cannot provide satisfactory steering stability nor substantial increase of the speed.

The inventor has made also an investigation on various hull shapes of tanker vessels and crude oil storage floating structures, and found that no further study has been made up to now for adopting the hemispherical shape of the hull.

SUMMARY OF THE INVENTION

Under these circumstances, the present invention aims at providing a novel construction of hull of a vessel such as a tanker.

Namely, it is a primary object of the invention to provide a hull construction which offers the maximum internal volume for a given outer surface area to permit an economical use of the construction material.

Another object of the invention is to provide a hull construction of a vessel such as a tanker which offers both of an improved steering stability and increased navigation speed.

To these ends, according to the invention, there is provided a hull basically composed of three hemispheres, at least of two of the hemispheres having an equal diameter, the three hemispheres being connected to one another such that the lines connecting the center of the hemisphere located at the bow side to the centers of the two hemispheres of the equal diameter constitute two sides of an equilateral triangle.

Other objects, features and advantages of the invention will become clear from the following description of the preferred embodiment taken in conjunction with the accompanying drawings. It is to be noted, however, that the embodiment is only for illustrative purpose and are not intended for limiting the scope of the invention.

DESCRIPTION OF THE PREFERRED EMBODIMENT

Figure 1:
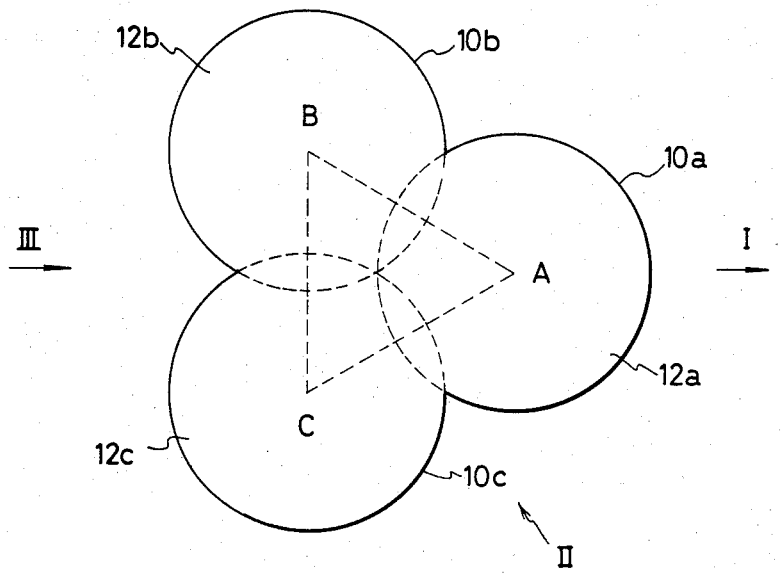
FIG. 1 is a schematic plan view of an embodiment of a hull structure of a tanker or the like in accordance with the invention.

Referring to the drawings, a hull is composed of three hemispheres 12*a*, 12*b* and 12*c* the outer surfaces, i.e. steel shell portions, of which are designated at numerals 10*a*, 10*b* and 10*c*. In the drawings, an arrow I indicates the forward or bow direction. Two hemispheres 12*b* and 12*c* positioned at the stern side have a substantially equal diameter which can be increased, for example, to about 100 m. The line AB connecting the center A of the bow-side hemisphere 12*a* and the center B of a stern-side hemisphere 12*b* has a length equal to that of the line AC connecting the center A to the center C of the other stern-side hemisphere. Thus, the triangle ABC is an equilateral triangle. Three hemispheres 12*a*, 12*b* and 12*c* are connected to one another so as not to leave any gap between adjacent ones.

In the actual building of this hull, the hemispheres are made wholly from steel sheets. The building of spheres from steel sheets can be made without substantial difficulty by making use of technics commonly used in the building of, for example, ground or underground gas tanks. The connection of three hemispheres to one another can be made easily by welding. According to the invention, the internal volume, i.e. the loading capacity for loading crude oil in case of tanker, can be maximized with minimized surface area, i.e. minimized consumption of the steel sheet. In addition, the structure composed of three hemispheres 12*a*, 12*b* and 12*c* exhibits a superior stability when floated on the sea water for the same principle as a tripod for cameras. In addition, this structure is superior also from the view point of mechanical strength.

As a modification, in the hull in accordance with the invention, three hemispheres 12*a*, 12*b* and 12*c* can have a substantially equal diameter. In this case, it is possible to connect three hemispheres 12*a*, 12*b* and 12*c* such that the lines AB, AC and BC interconnecting the centers of these hemispheres have an equal length so that these lines in combination form a regular triangle. In such a case, the hull has no specific orientation and exhibits a good grasping characteristics when stationed on the sea. The hull structure of this type, therefore, can be used suitably as an off-shore crude oil storage station.

The hull of the invention has an outer configuration as described hereinbefore. It will be clear to those skilled in the art that the interiors of three hemispheres 12*a*, 12*b* and 12*c* are divided into a multiplicity of sections each of which receive cargo such as crude oil as in the case of the conventional tanker hull. With the current advanced computer technology, it is not difficult to equally distribute the cargo crude oil to all sections of all hemispheres to stabilize the hull.

According to the invention, it is essential that at least the underwater portion beneath the draft line of the hull is composed of three hemispheres 12*a*, 12*b* and 12*c*, and the invention does not exclude addition of upper structures such as castles and houses of any desired sapes. It is even possible to form the upper structures in the form of hemispheres so that the hull as a whole is composed of three spheres connected to one another. It is to be noted also that the hull in accordance with the invention has an overall length and width much smaller than those of conventional hulls having an equal internal volume.

Figure 2:
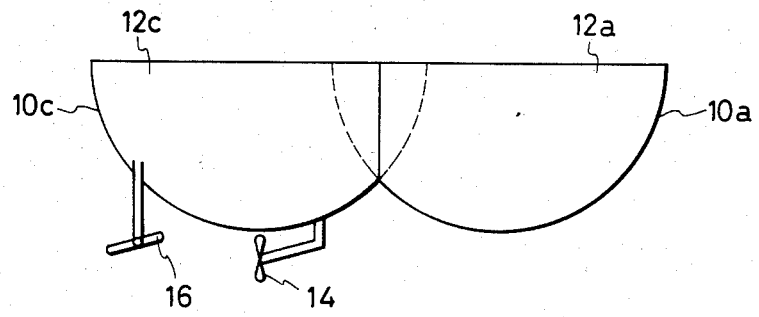
FIG. 2 is a side elevational view of the hull as viewed in the direction of an arrow II in FIG. 1.
Figure 3:
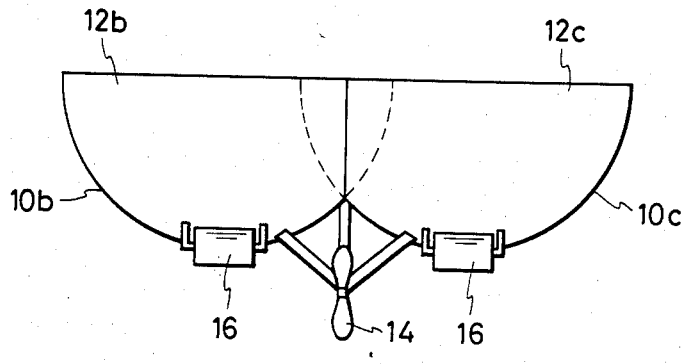
FIG. 3 is a side elevational view of the hull as viewed in the direction of an arrow III in FIG. 1.
Figure 4:
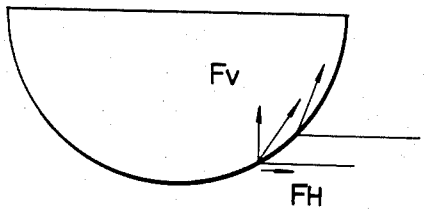
FIG. 4 is an illustration of the forces acting on a hemisphere, wherein $F_V$ and $F_H$ represent, respectively, a vertical component and a horizontal component of the force.

Referring now to FIGS. 2 and 3, a vessel having a hull in accordance with the invention can have a screw 14 as a propelling means and stern blades 16. The screw 14 as the propelling means may be substituted by a water jet or the like. It is to be noted that the hull construction of the invention offers a high propelling efficiency because the draft gets smaller as the speed is increased as will be explained later.

The tail blade 16, attached to the stern side of each of two hemispheres of equal diameter, serves to prevent pitching and rolling of the hull and to reduce the draft as the speed is increased. It is true that a specific consideration has to be made as to the design of the structures for supporting these stern blades 16 from the view point of theory of structures. However, such design is not described here because it does not constitute any essential part of this invention. Preferably, the stern blades 16 are constructed and mounted in such a manner as to permit the adjustment of elevation angle. Namely, the stern blades are controlled such that the elevation angle is decreased as the ship speed is increased.

The hull construction of the invention offers the following advantages.

Firstly, it is to be understood that the shell material is saved considerably for a given internal volume of the hull. In addition, it is possible to increase the tonnage remarkably. A test calculation showed that a total tonnage of about 7,000,000 tons is attainable.

Secondly, the hull constructed in accordance with the invention exhibits a high stability against strong waves and winds, as well as a large stability against pitch and roll, because the floating force is applied equally to three hemispheres to make the latter produce self supporting forces as in the case of legs of a tripod.

Thirdly, it is possible to attain a remarkable increase in the running speed. Since at least the underwater portion of the hull is constituted by hemispheres, an upward lift is increased as the running speed is increased so that the draft becomes smaller to reduce the influence of the external forces such as those produced by friction resistance and wave making resistance. As stated before, the elevation angle of the stern blades 16 is controlled to reduce the draft in accordance with the increase of the speed.

As has been described, according to the invention, there is provided a hull basically composed of three hemispheres, at least of two of the hemispheres having an equal diameter, the three hemispheres being connected to one another such that the lines connecting the center of the hemisphere located at the bow side to the centers of the two hemispheres of the equal diameter constitute two sides of an equilateral triangle. With this hull construction, it is possible to save the structural material while remarkably increasing the internal volume. It is also possible to stabilize the vessel on the ocean and to save the fuel by increasing the speed. Thus, the hull construction of the invention is suited for use as the hull construction for vessels such as tankers or off-shore crude oil storage stations.

Although the invention has been described through specific terms, it is to be noted here that the described embodiment is not exclusive and various changes and modifications may be imparted thereto without departing from the scope of the invention which is limited solely by the appended claims.

What is claimed is:

1. A vessel such as a tanker for transporting large volumes of material great distances over the high seas, said vessel comprising a hull and means integral with said hull for propelling said hull great distances over the surface of the seas, said hull including three hemispheres floatable on the surface of the seas and constructed and interconnected to withstand the waves of the high seas, at least two of said hemispheres having equal diameters and being located at the stern of the vessel, the remaining hemisphere being located at the bow of the vessel, said three hemispheres being rigidly interconnected such that lines between the centers of each pair of hemispheres are each shorter than the sum of the radii of the pair of hemispheres and lines between the respective centers of said two hemispheres of equal diameter at the stern of the vessel and the center of the third hemisphere at the bow of the vessel constitute two equal sides of a triangle, said triangle lying in a plane no lower than the water line of said hull.

2. A hull according to claim 1, wherein said three hemispheres have substantially equal diameters and are connected such that three lines connecting the centers of these hemispheres constitute three equal sides of a triangle.

3. A hull according to either one of claims 1 and 2, characterized by comprising two stern blades mounted on the lower portions of the stern-side hemispheres of equal diameter.

4. A hull according to claim 3, wherein the elevation angle of each stern blade is adjustable.

* * * * *